US008768192B2

(12) United States Patent
Ishikawa

(10) Patent No.: US 8,768,192 B2
(45) Date of Patent: Jul. 1, 2014

(54) FIXING APPARATUS OF INDUCTION HEATING TYPE FOR FIXING IMAGE FORMED ON SHEET

(71) Applicant: Canon Kabushiki Kaisha, Tokyo (JP)

(72) Inventor: Junji Ishikawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/894,795

(22) Filed: May 15, 2013

(65) Prior Publication Data

US 2013/0251391 A1 Sep. 26, 2013

Related U.S. Application Data

(62) Division of application No. 12/615,879, filed on Nov. 10, 2009, now Pat. No. 8,461,497.

(30) Foreign Application Priority Data

Nov. 11, 2008 (JP) ..... 2008-288944

(51) Int. Cl.
*G03G 15/20* (2006.01)
*H05B 6/06* (2006.01)
*H05B 6/08* (2006.01)

(52) U.S. Cl.
USPC ..... 399/67; 219/663; 219/667

(58) Field of Classification Search
USPC ..... 399/67, 88; 219/494, 660, 661, 663, 219/667, 490
See application file for complete search history.

(56) References Cited

U.S. PATENT DOCUMENTS

2008/0049470 A1* 2/2008 Ishio et al. ..... 363/78

FOREIGN PATENT DOCUMENTS

| | | | | |
|---|---|---|---|---|
| JP | 2000-223253 A | | 8/2000 | |
| JP | 2004-004205 A | | 1/2004 | |
| JP | 2004004205 A | * | 1/2004 | ..... G03G 15/20 |
| JP | 2007-027104 A | | 2/2007 | |

* cited by examiner

*Primary Examiner* — Billy Lactaoen
(74) *Attorney, Agent, or Firm* — Canon USA, Inc. IP Division

(57) ABSTRACT

A fixing apparatus includes an induction heating coil configured to heat a heat generating member including a conductive heating element, a boosting circuit configured to boost a DC voltage obtained by rectifying AC power, a switching element configured to input a DC voltage boosted by the boosting circuit and to supply a high-frequency current to the induction heating coil, a driving circuit configured to drive the switching element, a temperature detection unit configured to detect a temperature of the heat generating member, and a control unit configured to control power supplied to the induction heating coil by controlling a boosting ratio of the boosting circuit and a driving frequency of the switching element by the driving circuit so that the temperature detected by the temperature detection unit reaches a target temperature.

18 Claims, 14 Drawing Sheets

FIG. 9

| No | POWER P | BOOSTING CIRCUIT OUTPUT VOLTAGE Vo | DRIVING FREQUENCY f |
|---|---|---|---|
| 1 | P1 | V1 | f1 |
| 2 | P2 | V2 | f1 |
| 3 | P3 | V3 | f1 |
| 4 | Pr | Vi | f1 |
| 5 | P5 | Vi | f5 |
| 6 | P6 | Vi | f6 |
| 7 | P7 | Vi | f7 |
| 8 | 0 | Vi | STOP |

FIXING APPARATUS OF INDUCTION HEATING TYPE FOR FIXING IMAGE FORMED ON SHEET

CROSS-REFERENCE TO RELATED APPLICATIONS

This application is a divisional of U.S. patent application Ser. No. 12/615,879 filed Nov. 10, 2009, which claims priority from Japanese Patent Application No. 2008-288944 filed Nov. 11, 2008, all of which are hereby incorporated by reference herein in their entirety.

BACKGROUND OF THE INVENTION

1. Field of the Invention

The present invention relates to power supply circuitry for an inductive heating element. A fixing apparatus of the induction heating type may be incorporated in an image forming apparatus, and the power supply circuitry may be used to supply power to an inductive heating element in such fixing apparatus.

2. Description of Related Art

The image forming apparatus generally contains a fixing device for fixing a toner image transferred to a recording material. As the fixing device, a heating type device using a ceramic heater or a halogen heater has conventionally been used in many cases. Recently, an electromagnetic induction heating type device has begun to be used (refer to Japanese Patent Application Laid-Open No. 2000-223253).

FIG. 12 illustrates a simple frequency control method employed for power control of a power supply unit, which supplies power to a fixing device of the induction heating type. In steps 4001 and 4002, detected power P is compared with target power Po. In the case of P>Po, then in step 4005, the frequency is increased by a predetermined value fa. In the case of P<Po, then in step 4004, the frequency is decreased by a predetermined value fb. In the case of P=Po, then in step 4003, the frequency is maintained.

FIG. 13 illustrates a simple frequency control method employed for temperature control of the fixing device. In steps 5001 and 5002, a detected temperature T is compared with a target temperature To. In the case of T>To, then in step 5005, the frequency is increased by a predetermined value fa. In the case of T<To, then in step 5004, the frequency is decreased by a predetermined value fb. In the case of T=To, then in step 5003, the frequency is maintained.

FIG. 14 illustrates a relationship between a driving frequency f and power P. As illustrated in FIG. 14, maximum power Pmax is supplied to a coil at a resonance frequency f1. Characteristically, supplied power is reduced when the frequency changes to a high-frequency side or a low-frequency side relative to the resonance frequency f1. Thus, it is possible to achieve power control by controlling the driving frequency f within a frequency range fh above the resonance frequency f1, in which range the power-frequency characteristic has a slope. It is also possible to control the power by controlling the driving frequency within a frequency range f1 below the resonance frequency f1.

More specifically, in a frequency control system, to reduce power, the driving frequency for a switching element, which is used to supply power to the coil, is set higher than the resonance frequency. However, when the driving frequency becomes higher than the resonance frequency, switching losses of the switching element may increase. Losses are particularly conspicuous when a large-power operation is performed in a state in which the driving frequency deviates from the resonance frequency.

Moreover, in a DC voltage control system for controlling power only based on a change in DC voltage supplied to the switching element, both a boosting circuit and a de-boosting circuit are required, thus leading to a great increase in production cost and circuit size.

SUMMARY OF THE INVENTION

It is desirable to provide power supply circuitry capable of reducing losses of a switching element during a large-power operation while suppressing an increase in cost and size of the circuitry.

According to an aspect of the present invention, a fixing apparatus includes an induction heating coil configured to heat a heat generating member including a conductive heating element, a boosting circuit configured to boost a DC voltage obtained by rectifying AC power, a switching element configured to input a DC voltage boosted by the boosting circuit and to supply a high-frequency current to the induction heating coil, a driving circuit configured to drive the switching element, a temperature detection unit configured to detect a temperature of the heat generating member, and a control unit configured to control power supplied to the induction heating coil by controlling a boosting ratio of the boosting circuit and a driving frequency of the switching element by the driving circuit so that the temperature detected by the temperature detection unit reaches a target temperature. The control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 is a table illustrating a relationship among power, an output voltage of a boosting circuit and a driving frequency according to a third exemplary embodiment of the present invention.

DESCRIPTION OF THE EMBODIMENTS

Various exemplary embodiments, features, and aspects of the invention will be described in detail below with reference to the drawings.

Figure 1:
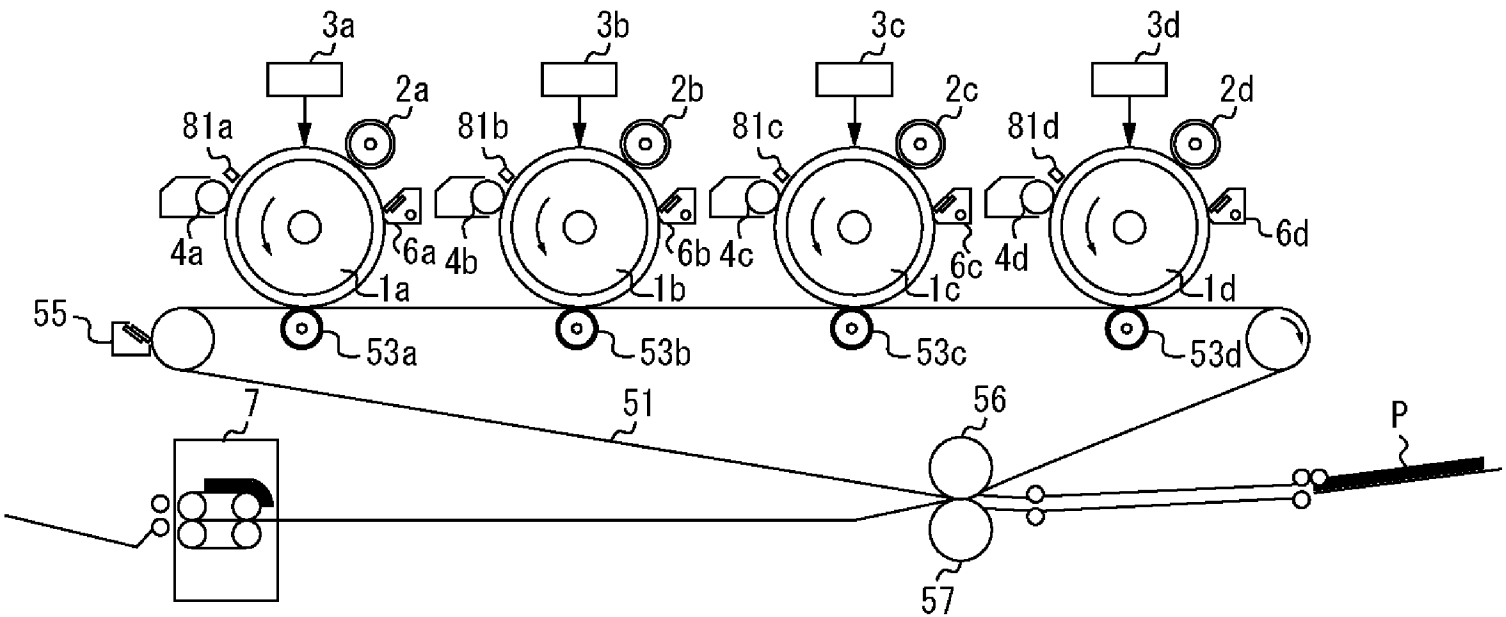
FIG. 1 is a sectional diagram illustrating a configuration of an image forming apparatus according to an exemplary embodiment of the present invention.

FIG. 1 is a sectional diagram illustrating a configuration of a color image forming apparatus according to a first exemplary embodiment of the present invention. The apparatus is an image forming apparatus that uses an electrophotography process.

After uniform charging of photosensitive members 1*a* to 1*d* by primary charging units 2*a* to 2*d*, exposure units 3*a* to 3*d* irradiate the photosensitive members 1*a* to 1*d* with laser beams modulated according to an image signal to form electrostatic latent images on the photosensitive members 1*a* to 1*d*. Then, developing units 4*a* to 4*d* develop toner images. Primary transfer units 53*a* to 53*d* transfer the toner images on the four photosensitive members 1*a* to 1*d* to an intermediate transfer belt 51 in a superimposed manner. Further, secondary transfer units 56 and 57 transfer the toner images to recording paper P. Cleaners 6*a* to 6*d* collect toner left untransferred on the photosensitive members 1*a* to 1*d*. An intermediate transfer belt cleaner 55 collects toner left untransferred on the intermediate transfer belt 51. A fixing device 7 fixes the toner image transferred to the recording paper P, so that a color image is obtained. The fixing device 7 has a configuration of the electromagnetic induction heating type.

Figure 2:
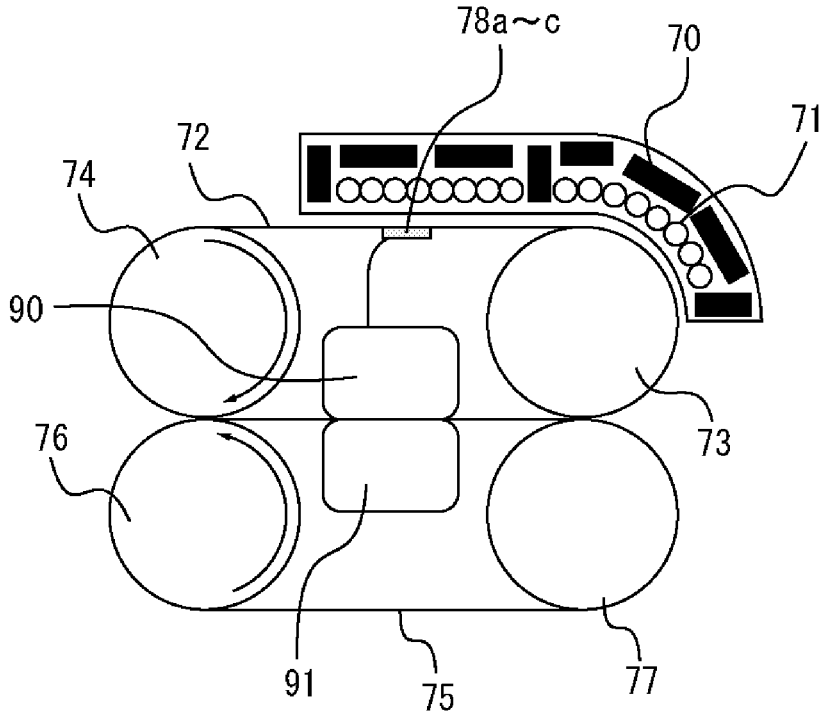
FIG. 2 is a sectional diagram illustrating a configuration of a fixing device.

FIG. 2 is a sectional diagram illustrating the configuration of the fixing device of the electromagnetic induction heating type. A fixing belt 72 is a metal belt serving as a heating member, which includes a conductive heating element, and its surface is covered with a rubber layer of 300 μm. The fixing belt 72 rotates around rollers 73 and 74 in a shown arrow direction. A fixing belt 75 rotates around rollers 76 and 77 in a shown arrow direction. An induction heating coil 71 is located in a coil holder 70 opposite the fixing belt 72, which includes a conductive heating element. An AC current flows through the coil 71 to generate a magnetic field, so that the conductive heating element of the belt 72 generates heat by itself. Thermistors 78*a*, 78*b* and 78*c* are located in contact with center, rear, and front sides of the belt 72 in a depth direction to detect a temperature of the belt 72. The thermistors 78*a*, 78*b* and 78*c* are resistors that exhibit resistance values higher as a temperature is lower. In the fixing device 7, an AC current flowing through the coil 71 is increased or decreased so that the temperature detected by the center thermistor 78*a* reaches 190° C., which is a target temperature. Upper and lower pads 90 and 91 apply pressure of about 40 kg weight on the belts 72 and 75.

Figure 3:
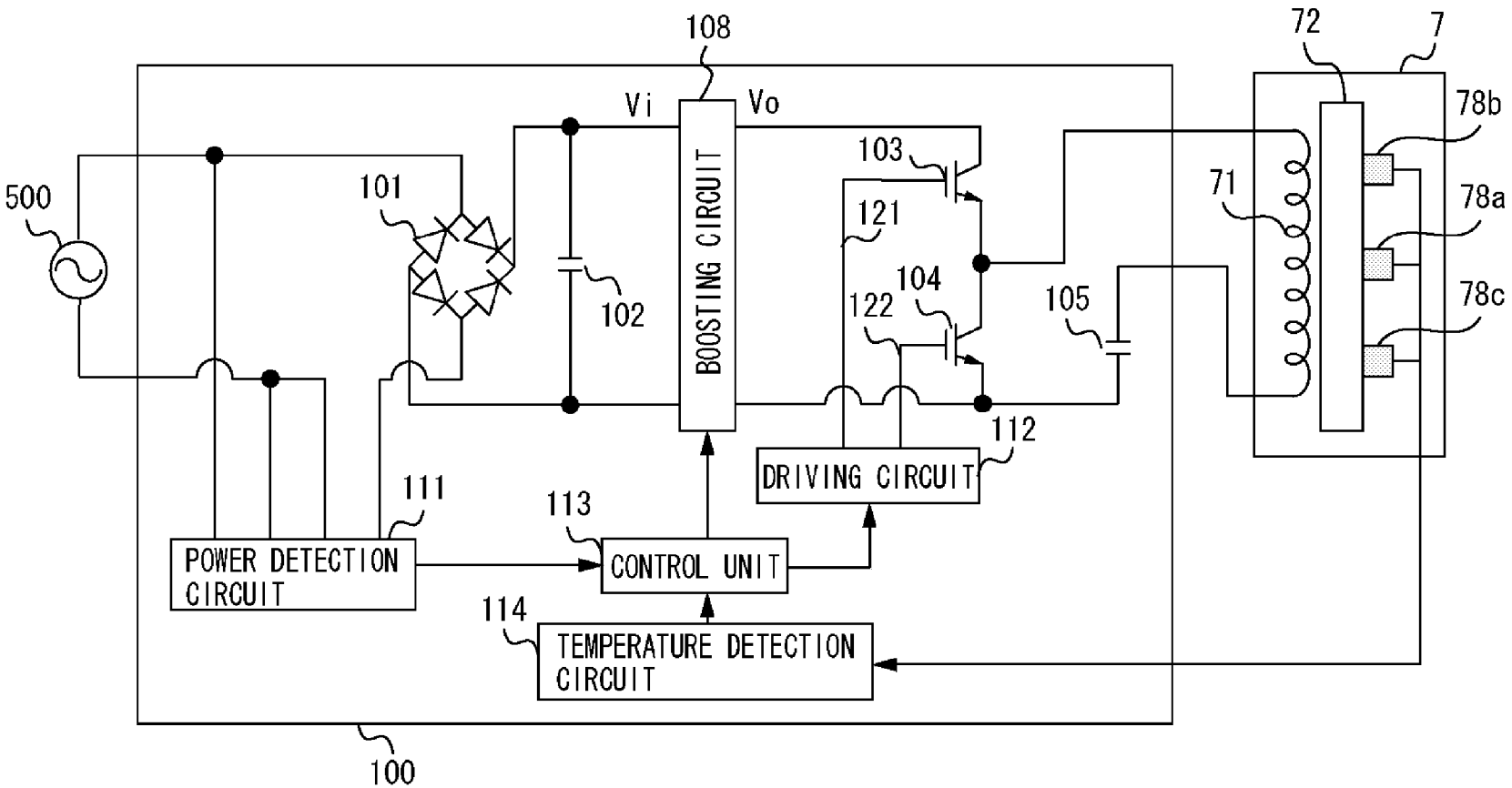
FIG. 3 is a circuit diagram illustrating a configuration of a power supply unit of the fixing device.

FIG. 3 is a block diagram illustrating a configuration of a power supply unit 100, which supplies power to the fixing device 7 of the induction heating type. An AC power source 500 supplies power to the power supply unit 100. An AC voltage from the AC power source 500 is rectified by a diode bridge 101, and the rectified voltage is smoothed by a filter capacitor 102. A resonance capacitor 105 constitutes a resonance circuit with the coil 71. A boosting circuit 108 boosts a DC voltage rectified by the diode bridge 101, and its boosting ratio is variable. For example, the boosting ratio changes within a range of 1 to 3. First and second switching elements 103 and 104 control power supplied to the coil 71. A switch driving circuit 112 drives the switching elements 103 and 104 with switch driving signals 121 and 122. The boosting circuit 108, switching elements 103, 104, switch driving circuit 112 and capacitor 105 form part of a driving signal generator which supplies coil driving signals to the coil 71. A control unit 113 controls the boosting circuit 108 and the switch driving circuit 112. A power detection circuit 111 detects input power from the AC power source 500. A temperature detection circuit 114 detects a temperature of the belt 72 based on signals from the thermistors 78*a* to 78*c*. The control unit 113 determines power to be supplied to the coil 71 based on a detection result from the power detection circuit 111 and a detection result from the temperature detection circuit 114, and determines driving frequencies of the switch driving signals 121 and 122 output from the switch driving circuit 112 and a boosting ratio of the boosting circuit 108 so that power supplied to the coil 71 reaches the determined power. The switching elements 103 and 104 are alternately turned ON/OFF according to the switch driving signals 121 and 122 to supply coil driving signals (a high-frequency current) to the coil 71.

With the above-described configuration, the power supply unit 100 operates in a frequency control mode when using a first power range in which the boosting circuit 108 operates at a boosting ratio of 1, i.e., Vo=Vi, and operates in a voltage control mode when using a second power range higher than the first power range.

Figure 4:
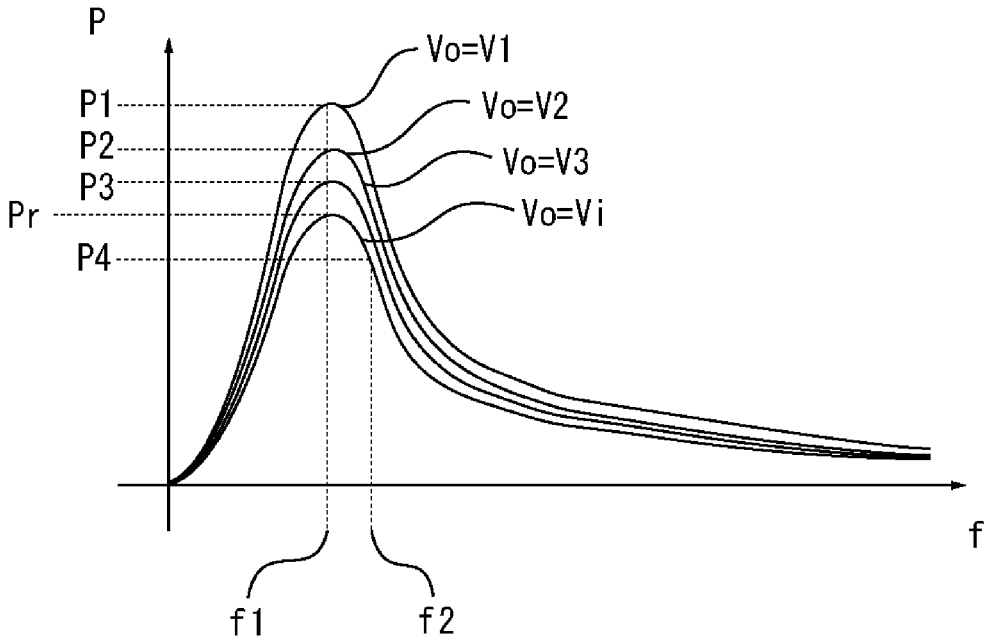
FIG. 4 illustrates a relationship between a driving frequency of a coil and power.

FIG. 4 illustrates a relationship between frequencies of the switch driving signals 121 and 122 of the switching elements 103 and 104 output from the switch driving circuit 112 and power supplied to the coil 71.

In a characteristic curve when the boosting ratio of the boosting circuit 108 is maintained at 1, i.e., Vo=Vi, power P supplied to the coil 71 is set equal to reference power Pr (P=Pr) when a frequency f of the driving signal is a resonance frequency f1. When the frequency f of the driving signal is increased from f1 to f2, the power P is set to P4 lower than the reference power Pr. When the frequency of the driving signal is increased more and more, the power P can be reduced more. To increase the power P more than the reference power Pr, the boosting ratio of the boosting circuit 108 is increased while the frequency f of the driving signal is maintained at f1. In other words, increasing the boosting ratio as Vo=V3, V2, and V1 (V3<V2<V1) in order results in an increase in power supplied to the coil 71 as P3, P2, and P1. Thus, the power P can be increased without increasing switching losses.

Figure 5:
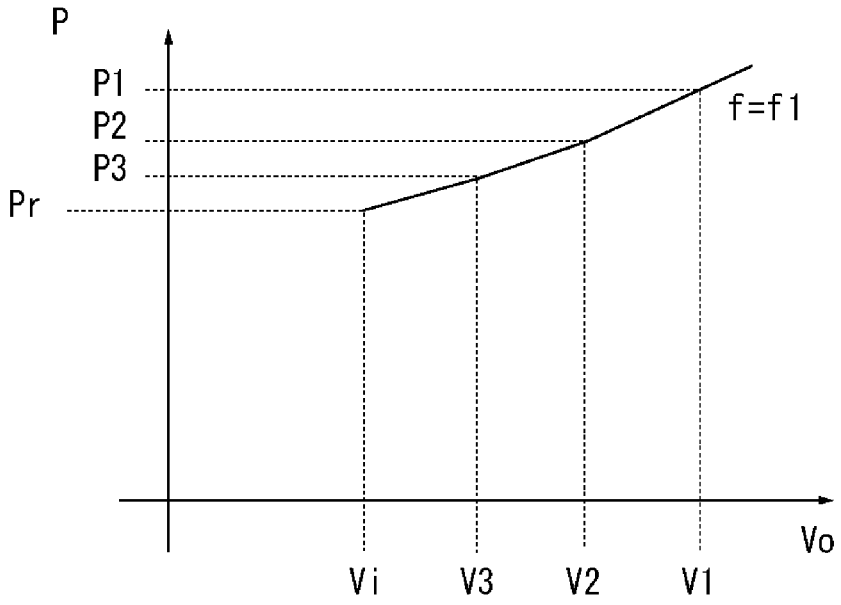
FIG. 5 illustrates a relationship between an output voltage of a boosting circuit and power.

FIG. 5 illustrates a relationship between an output voltage Vo of the boosting circuit 108 and power P when frequencies f of the driving signals 121 and 122 are equal to the resonance frequency f1.

Thus, in the present exemplary embodiment, two modes of power control, frequency control mode and voltage control mode, are set, and each control mode is selectively executed.

Specifically, the frequency control mode is a mode (first control mode) for controlling power to be supplied by changing the driving frequency of the switching element within a range of frequencies equal to or higher than a predetermined frequency in a state where the boosting ratio of the boosting circuit 108 is maintained at a predetermined boosting ratio. The voltage control mode is a mode (second control mode) for controlling power to be supplied by changing the boosting ratio of the boosting circuit 108 within a range of ratios equal to or higher than a predetermined boosting ratio in a state where the driving frequency of the switching element is maintained at a predetermined frequency.

Figure 6:
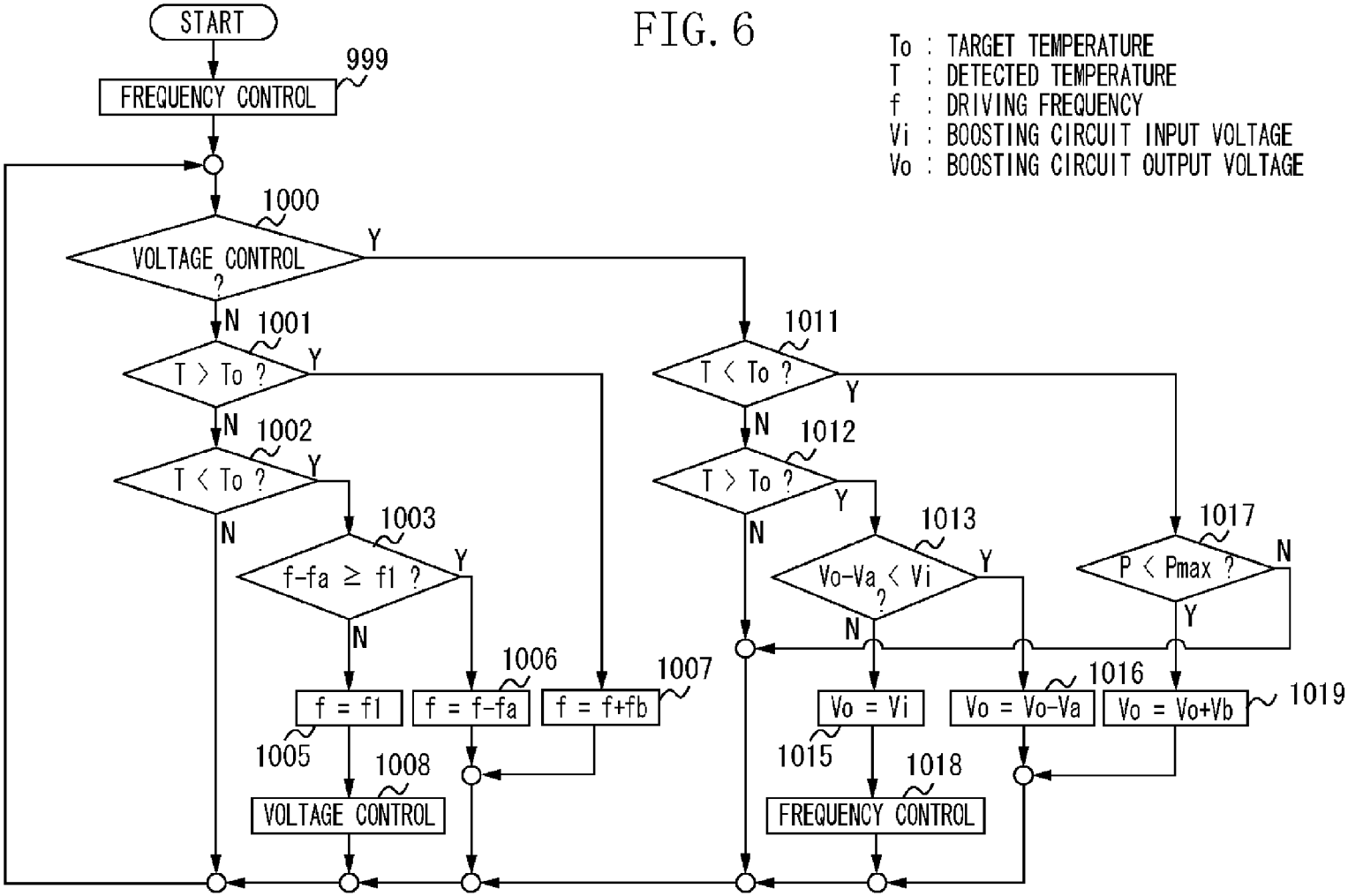
FIG. 6 is a control flowchart for a fixing device according to a first exemplary embodiment of the present invention.

FIG. 6 is a flowchart illustrating power control for the fixing device 7 executed by the control unit 113. In the present exemplary embodiment, it is presumed that a temperature T of the center of the belt 72, at which the thermistor 78*a* is located, is controlled to a target temperature To.

First, in step 999, the control unit 113 initially sets a mode of power control to the frequency control mode at the time of starting an operation. The initial setting of the mode to the frequency control mode is for the purpose of gradually increasing power from a low power state to increase the temperature of the belt 72 at the time of starting control. In step 1000, the control unit 113 determines whether the control mode is the voltage control mode at a point of this time. When determining that the mode is the frequency control mode, then in steps 1001 and 1002, the control unit 113 compares the detected temperature T based on an output of the thermistor 78*a* with the target temperature To. In the case of T>To, then in step 1007, to decrease the temperature of the belt 72, the control unit 113 increases the frequency by a predetermined value fb. The processing then returns to step 1000. In the case of T<To, the control unit 113 is required to increase the temperature of the belt 72. Then in step 1003, the control unit 113 determines whether a value obtained by decreasing the frequency by a predetermined value fa is higher than a resonance frequency f1, in other words, whether the value satisfies "f−fa≥f1". In the case of f−fa≥f1, then in step 1006, to increase the temperature of the belt 72, the control unit 113 decreases the frequency by the predetermined value fa. The processing then returns to step 1000. If not f−fa≥f1, then in step 1005, the control unit 113 sets the frequency to f1. In step 1008, the control unit 113 switches the mode of power control from the frequency control mode to the voltage control mode. The processing then returns to step 1000. In steps 1001 and 1002, in the case of T=To, the control unit 113 maintains the set frequency f.

When determining in step 1000 that the mode of power control is the voltage control mode at a point of this time, then in steps 1011 and 1012, the control unit 113 compares the detected temperature T based on the output of the thermistor 78*a* with the target temperature To. In the case of T<To, the control unit 113 is required to increase the temperature of the belt 72. Then in step 1017, the control unit 113 determines whether power P supplied to the coil 71 is less than upper limit power Pmax. If it is not the case that P<Pmax, the control unit 113 maintains an output voltage Vo of the boosting circuit 108 as it is. The processing then returns to step 1000. In the case of P<Pmax, then in step 1019, the control unit 113 sets the boosting ratio to increase the output voltage Vo of the boosting circuit 108 by a predetermined value Vb. The processing then returns to step 1000. In the case of T>To, then in step 1013, the control unit 113 determines whether a value obtained by decreasing the output voltage Vo of the boosting circuit 108 by a predetermined value Va is lower than an input voltage Vi of the boosting circuit 108, in other words, whether the value satisfies "Vo−Va<Vi". In the case of Vo−Va<Vi, then in step 1016, the control unit 113 sets the boosting ratio to decrease the output voltage Vo of the boosting circuit 108 by the predetermined value Va. The processing then returns to step 1000. If it is not the case that Vo−Va<Vi, then in step 1015, the control unit 113 sets Vo=Vi (boosting ratio to 1). Then, in step 1018, the control unit 113 switches the mode of power control from the voltage control mode to the frequency control mode. The processing then returns to step 1000. In the case of T=To, the control unit 113 maintains the output voltage Vo of the boosting circuit 108 as it is. The processing then returns to step 1000.

For example, assuming that an inductance of the fixing device 7 is 40 μH and a capacity of the resonance capacitor 105 is 1 μF, the resonance frequency f1 is about 25 kHz. When a voltage of the commercial power source 500 is 100 V, in the configuration of the present exemplary embodiment, the voltage Vi is about 140 V and the reference power Pr at this time is 500 W. Thus, the power supply unit 100 operates in the voltage control mode where the driving frequency is maintained at 25 kHz when supplying a power larger than 500 W, and operates in the frequency control mode (driving frequency 25 kHz or higher) where the output voltage of the boosting circuit 108 is maintained at 140 V when supplying a power smaller than 500 W.

As described above, when supplying a relatively large power (>500 W) which requires high efficiency, changing the boosting ratio while driving the switching element at the resonance frequency enables a reduction in losses of the switching element. When supplying a relatively small power (≤500 W), changing the driving frequency of the switching element enables power control without needing any de-boosting circuit.

Figure 7:
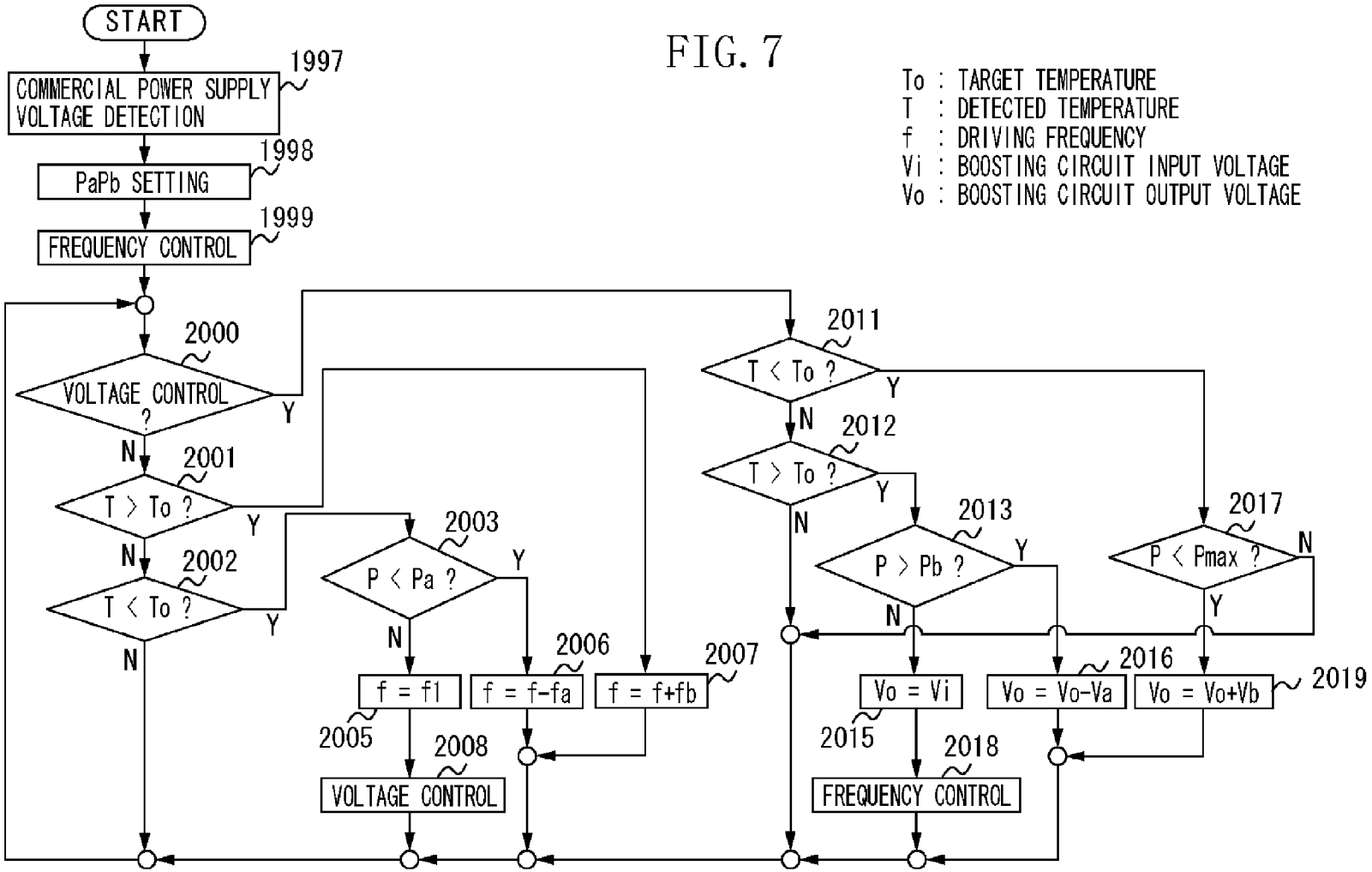
FIG. 7 is a control flowchart for a fixing device according to a second exemplary embodiment of the present invention.

Configurations of an image forming apparatus and a power supply unit according to a second exemplary embodiment of the present invention are similar to those of the first exemplary embodiment. FIG. 7 is a flowchart illustrating power control executed by the control unit 113 in the second exemplary embodiment. In the second exemplary embodiment, as in the case of the first exemplary embodiment, it is presumed that a temperature T of the center of the belt 72, at which the thermistor 78*a* is located, is controlled to a target temperature To. Also, the power supplied when the boosting ratio of the boosting circuit 108 is set to a predetermined boosting ratio (boosting ratio 1) and the driving frequency of the switching element is set to a predetermined frequency (resonance frequency f1) is used as a reference power Pr.

Figure 8:
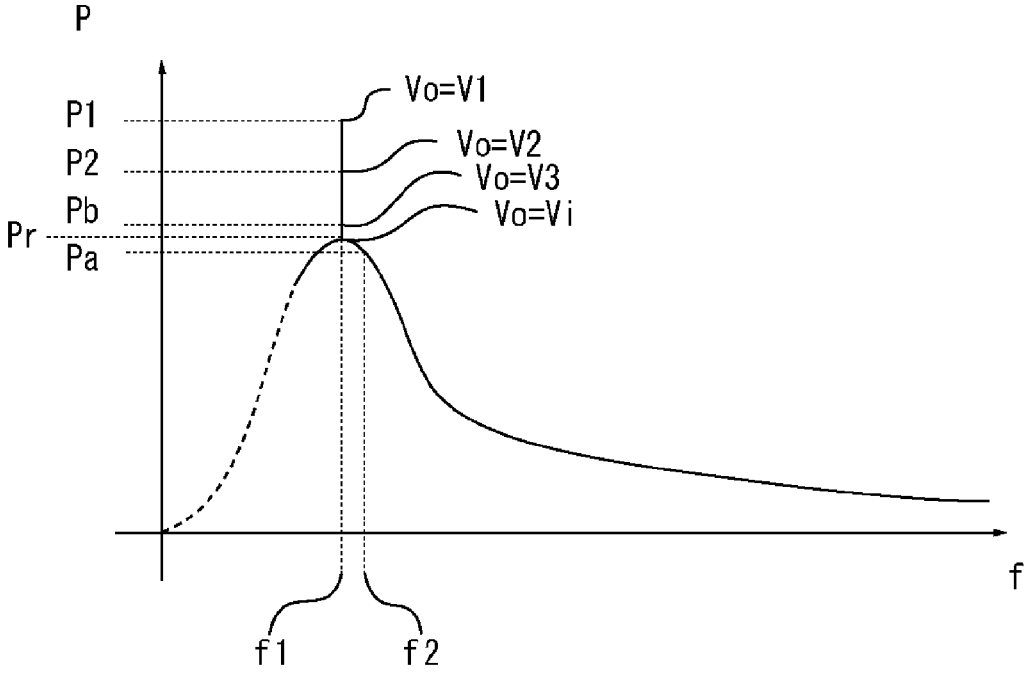
FIG. 8 illustrates a relationship among a driving frequency, an output voltage of a boosting circuit and power according to the second exemplar embodiment.

First, in step 1997, the control unit 113 detects a voltage of the commercial power source 500. In step 1998, the control unit 113 sets a power Pa and a power Pb, which are used as references for switching between the voltage control mode and the frequency control mode according to a voltage detection value. In other words, the power Pa is set to a first predetermined power lower than the reference power Pr. The power Pb is set to a second predetermined power larger than the reference power Pr. A relationship among Pa, Pb, and Pr is Pa<Pr<Pb as illustrated in FIG. 8. Next, in step 1999, the control unit 113 initially sets the mode of power control to the frequency control mode. The initial setting of the mode to the frequency control mode is for the purpose of gradually increasing power from low power at the time of starting control. In step 2000, the control unit 113 determines whether the mode of power control is the voltage control mode at a point of this time. When determining that the mode is not the voltage control mode but the frequency control mode, then in steps 2001 and 2002, the control unit 113 compares a detected temperature T with the target temperature To. In the case of T>To, then in step 2007, the control unit 113 increases the frequency by a predetermined value fb. The processing then returns to step 2000. In the case of T<To, then in step 2003, the control unit 113 compares power P supplied to the coil 71 with the set value Pa. In the case of P<Pa, then in step 2006, the control unit 113 decreases the frequency by a predetermined value fa. The processing then returns to step 2000. In the case of P≥Pa, then in step 2005, the control unit 113 sets the frequency to f=f1. In step 2008, the control unit 113 switches the mode of power control to the voltage control mode. In step 2002, if not T<To, in other words, in the case of T=To, the control unit 113 maintains the set frequency f as it is. The processing then returns to step 2000.

On the other hand, when determining in step 2000 that the mode of power control is the voltage control mode at a point of this time, then in steps 2011 and 2012, the control unit 113 compares the detected temperature T with the target temperature To. In the case of T<To, then in step 2017, the control unit 113 determines whether power P is less than upper limit power Pmax. If it is not the case that P<Pmax, the control unit 113 maintains the output voltage Vo of the boosting circuit 108. The processing then returns to step 2000. In the case of P<Pmax, then in step 2019, the control unit 113 increases the output voltage Vo of the boosting circuit 108 by the predetermined value Vb. The processing then returns to step 2000. In the case of T>To, then in step 2013, the control unit 113 compares power P with the set value Pb. In the case of P>Pb, then in step 2016, the control unit 113 decreases the output voltage Vo of the boosting circuit 108 by the predetermined value Va. The processing then returns to step 2000. In the case of P≥Pb, then in step 2015, the control unit 113 sets V0=Vi. In step 2018, the control unit 113 switches the mode of power control to the frequency control mode. If it is not the case that T>To in step 2012, in other words, T=To, the control unit 113 maintains the output voltage Vo of the boosting circuit 108. The processing then returns to step 2000.

For example, assuming that the inductance of the fixing device 7 is 40 μH and the capacity of the resonance capacitor 105 is 1 μF, the resonance frequency f1 is about 25 kHz. When the voltage of the commercial power source 500 is 100 V, the voltage Vi is about 140 V, and the power Pr at a point of this time is 500 W in the configuration of the fixing device 7 according to the present exemplary embodiment. In this case, the power Pa is set to 470 W, and the power Pb is set to 530 W.

When the voltage of the commercial power source 500 is 120 V, the power Pr is 720 W. In this case, the power Pa is set to 690 W, and the power Pb is set to 750 W.

Configurations of an image forming apparatus and a power supply unit according to a third exemplary embodiment of the present invention are similar to those of the first and second exemplary embodiments.

Figure 10:
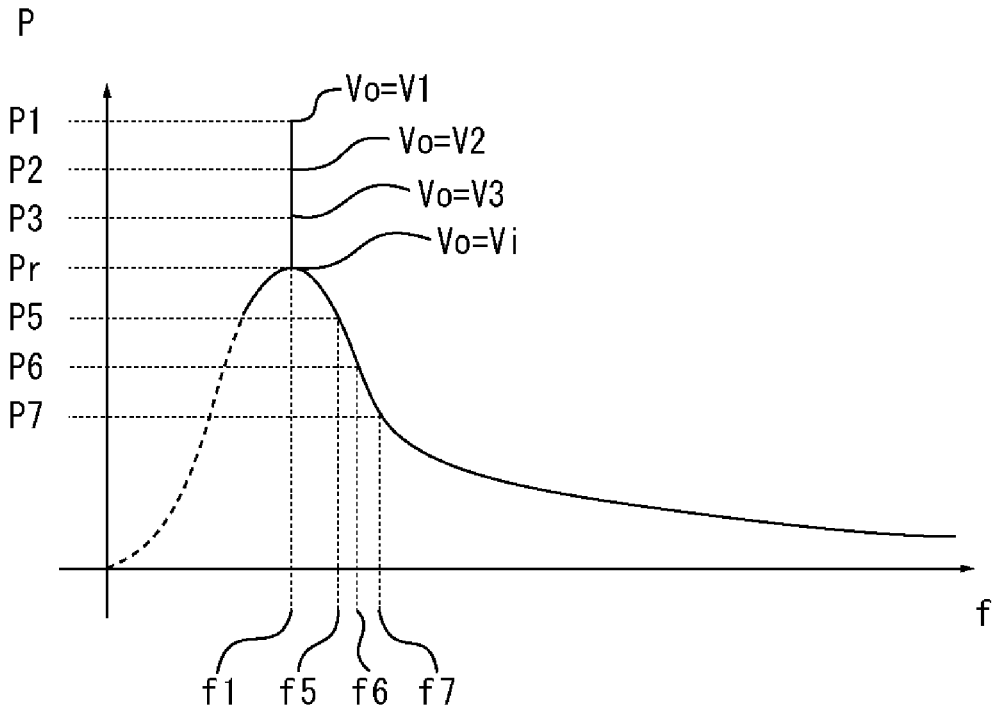
FIG. 10 illustrates a relationship in changes between the output voltage of the boosting circuit and the driving frequency according to the third exemplary embodiment.

In the third exemplary embodiment, the control unit 113 has a table storing data as illustrated in FIG. 9. The stored data is divided into a plurality of sets of data numbered from 1 to 8. Each set of data corresponds to a different power P (P1 to P7 or 0) and indicates a relationship between the output voltage Vo of the boosting circuit 108 and the driving frequency f applicable at the power concerned. The control unit 113 selects one of the data sets (combination of output voltage Vo (boosting ratio) and driving frequency f) in the table according to a difference between the target temperature and the detected temperature of the fixing device 7. FIG. 10 is a graphic representation of the relationship indicated in the table illustrated in FIG. 9.

By stepping through the data sets numbered 1 to 3 of the table, i.e., powers P1 to P3, the control unit 113 performs control in the voltage control mode, which maintains the frequency at f=f1 and changes the voltage Vo. In data set number 4, i.e., power Pr, the control unit 113 maintains the driving frequency at f=f1 and the voltage Vo=Vi. By stepping through the data sets numbered 5 to 7, i.e., powers P5 to P7, the control unit 113 performs control in the frequency control mode, which maintains the voltage Vo=Vi and changes the driving frequency f. In other words, with power Pr set as a boundary, the control unit 113 selects the voltage control mode when power higher than Pr is necessary, and the frequency control mode when power lower than Pr is necessary. In the present exemplary embodiment, there are eight combinations of Vo and f. However, more segmentation is available between the data numbers 1 and 8.

Figure 11:
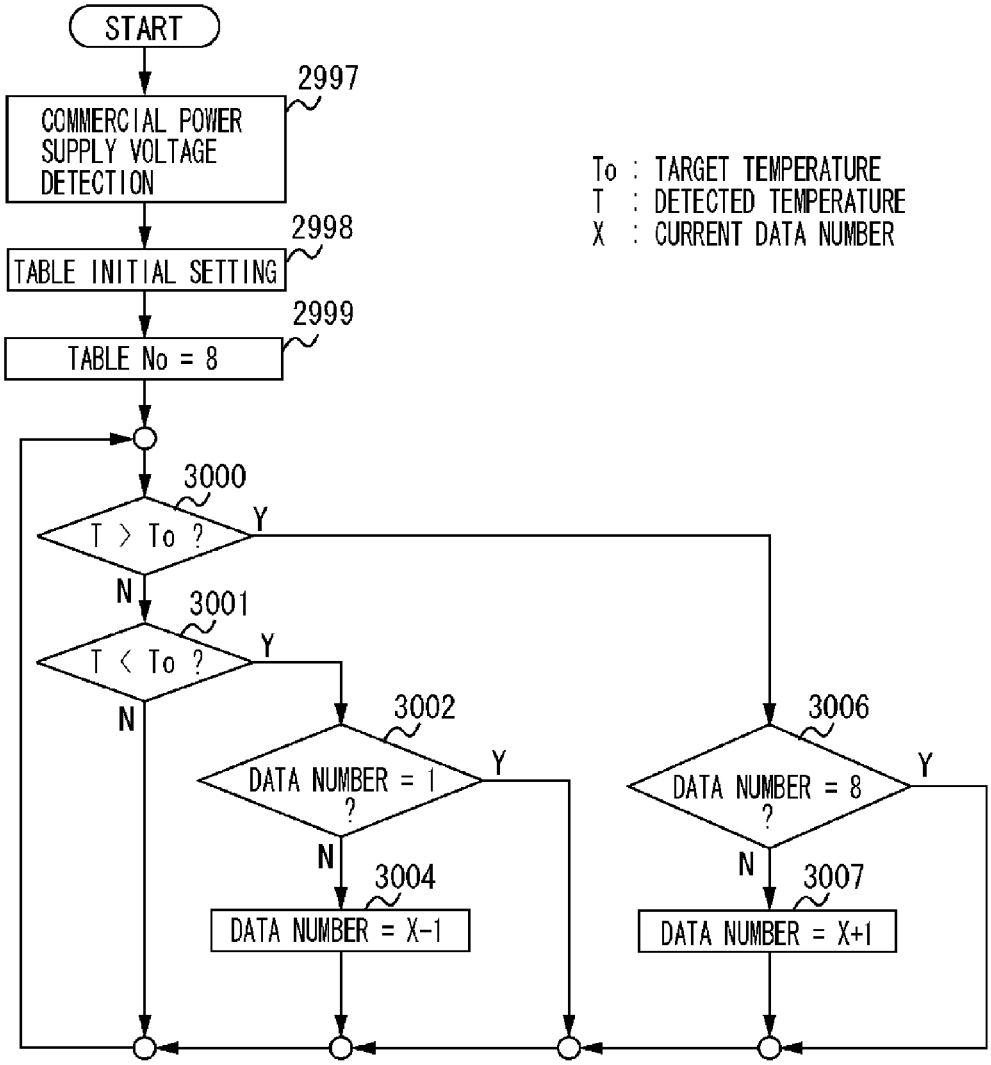
FIG. 11 is a control flowchart for a fixing device according to the third exemplary embodiment.
Figure 12:
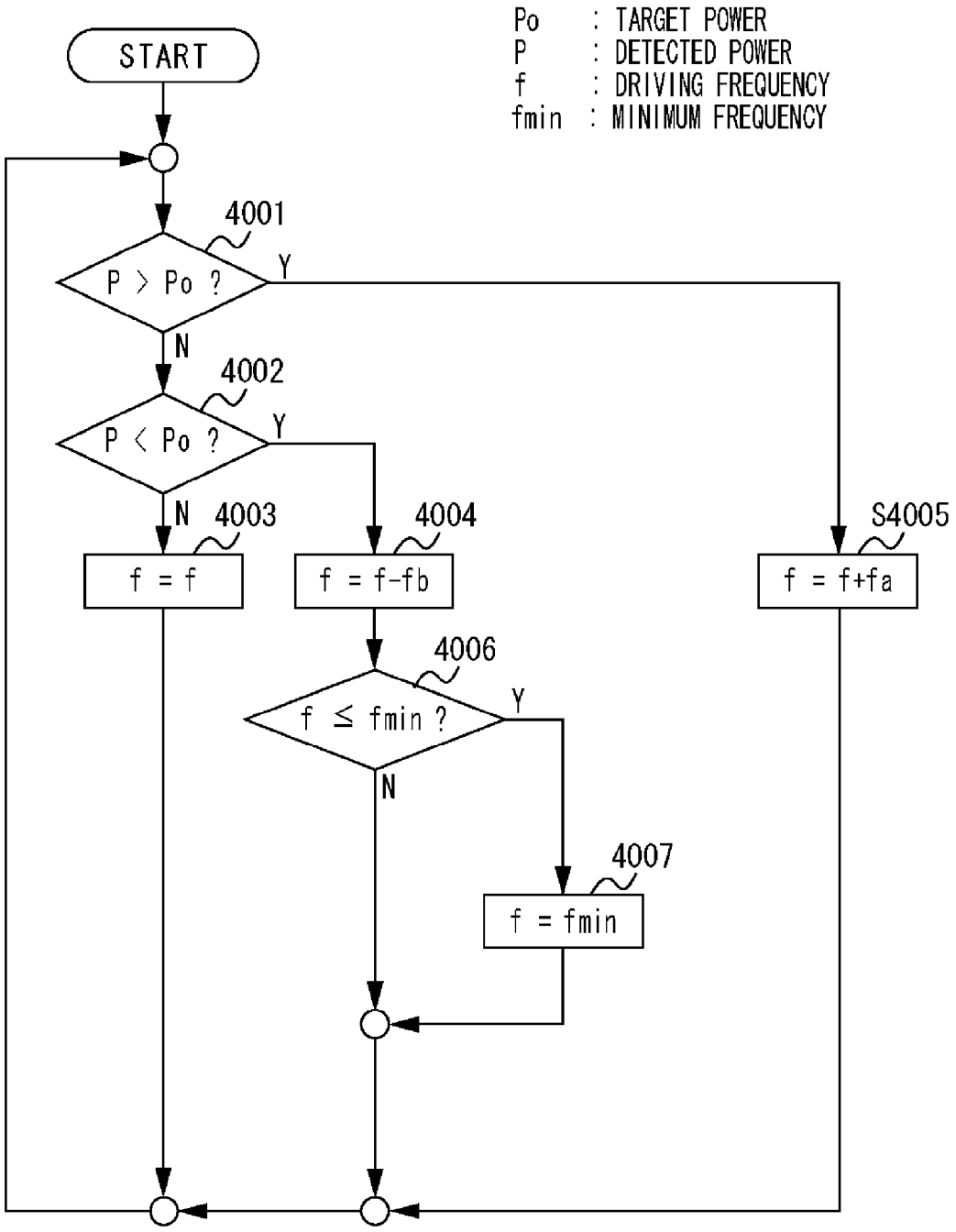
FIG. 12 is a power control flowchart based on frequency control of a conventional fixing device.
Figure 13:
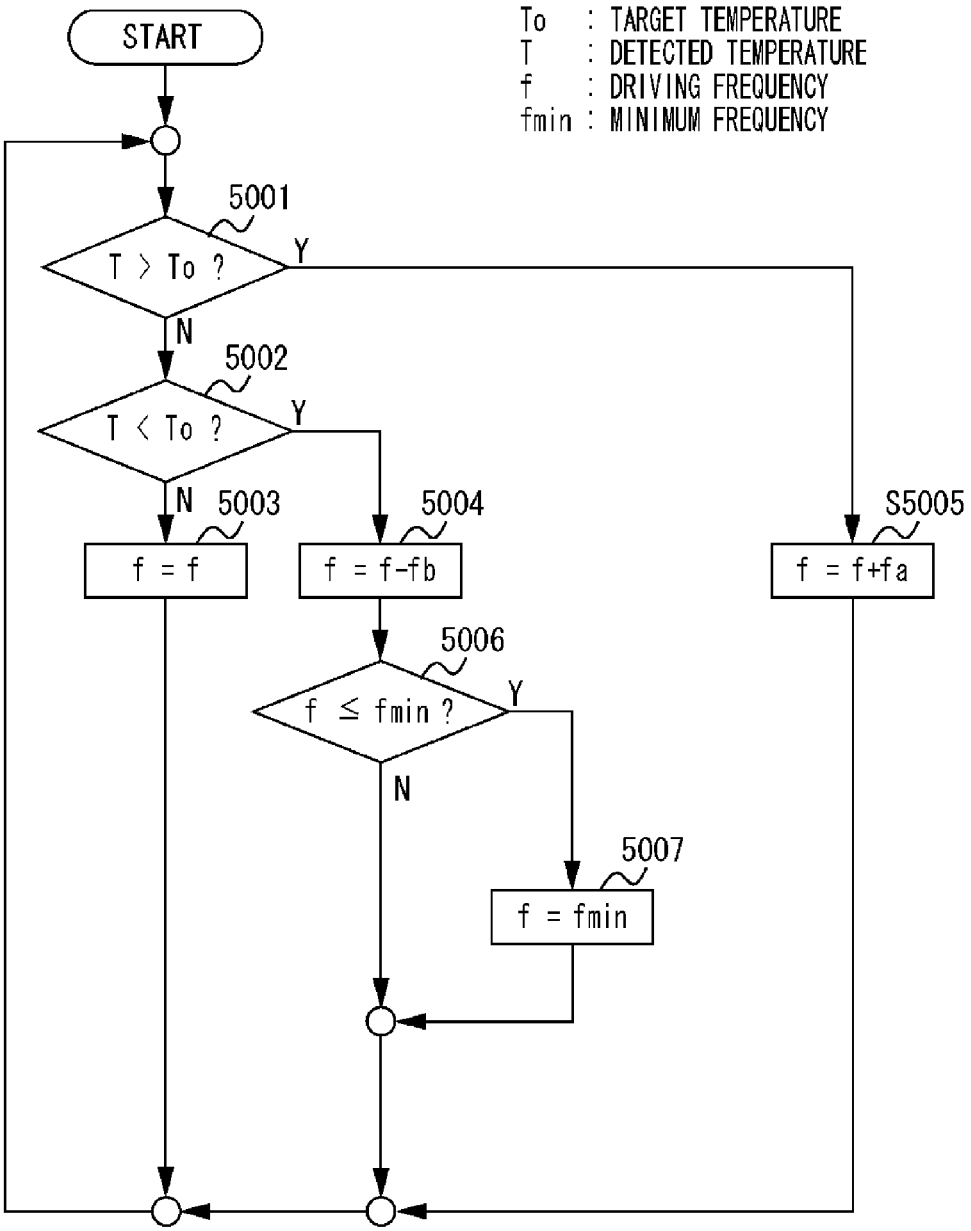
FIG. 13 is a temperature control flowchart based on the frequency control of the conventional fixing device.
Figure 14:
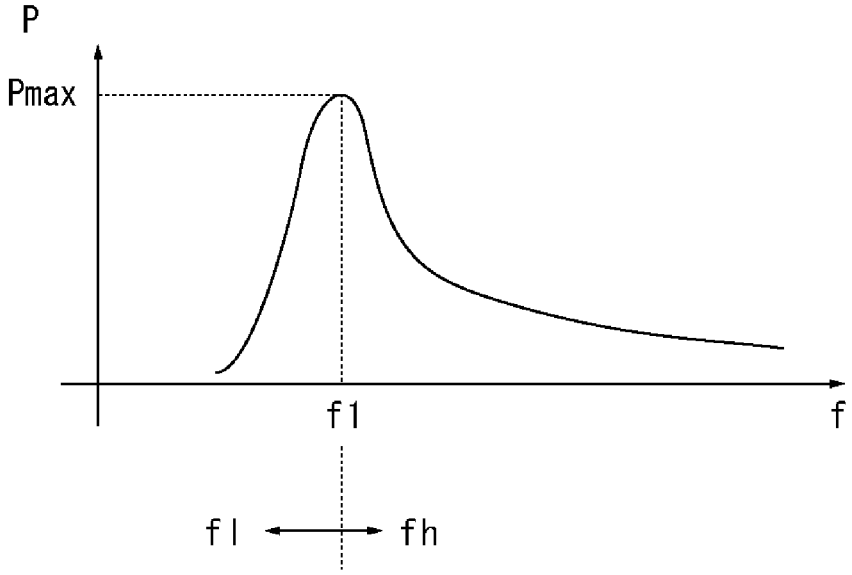
FIG. 14 illustrates a relationship between a driving frequency of a coil and power.

FIG. 11 is a flowchart illustrating power control executed by the control unit 113 according to the third exemplary embodiment. In the third exemplary embodiment, as in the case of the first and second exemplary embodiments, it is presumed that the temperature T of the center of the conductive heating element 72, at which the thermistor 78*a* is located, is controlled to a target temperature To.

When control is started, in step 2997, the control unit 113 detects the voltage of the commercial power source 500. In step 2998, the control unit 113 sets a table of combinations of output voltages Vo and driving frequencies f of the boosting circuit as illustrated in FIG. 9. More specifically, the control unit 113 determines whether the commercial AC power source is a 100 V or 200 V system. The control unit 113 sets a table for 100 V in the case of the 100 V system, and a table for 200 V in the case of the 200 V system. The control unit 113 may set different tables depending on countries or regions where the image forming apparatus is installed. Next, in step 2999, the control unit 113 sets a data set number, indicating a combination of the output frequency Vo of the boosting circuit and the driving frequency f, to 8. The data set number 8 indicates a power stop state. In step 3000, the control unit 113 compares the detected temperature T with the target temperature To. In the case of T>To, then in step 3006, the control unit 113 determines whether a data number X set at this point in time (hereinafter referred to as a current data set number) is 8, in other words, a stop state. If the data set number is 8, the control unit 113 maintains the data set number X as it is. The processing then returns to step 3000. If the data set number is not 8, the processing proceeds to step 3007. To decrease power to be supplied to the induction heating coil 71, the control unit 113 changes the combination to that of Vo and f set by a number higher by one than the current data set number X. Thus, when the fixing device 7 exceeds the target temperature, the control unit 113 may sequentially increase the data number X by repeating steps 3000, 3006, 3007, 3000, . . . , and even X=8 (power stop state) may be set.

If it is not the case that T>To in step 3000, the processing proceeds to step 3001. If T<To in step 3001, then in step 3002, the control unit 113 determines whether the current data set number X is 1, in other words, maximum power setting. If the data set number X is 1, the control unit 113 maintains the data set number as it is. The processing then returns to step 3000. If in step 3002 the data set number X is not 1, the processing proceeds to step 3004. In step 3004, to increase power to be supplied to the induction heating coil 71, the control unit 113 changes the combination to a combination of Vo and f set by a number lower by one than the current data set number X. Thus, when the fixing device 7 is cold at the time of turning-ON of power or the like, the control unit 113 may sequentially decrease the data set number X by repeating steps 3000, 3001, 3002, 3004, 3000, . . . , until X=1 is reached. If it is not the case that T<To in step 3001, the control unit 113 maintains the data number X as it is. The processing then returns to step 3000.

As described above, when supplying a relatively large power which requires high efficiency, changing the boosting ratio while driving the switching element with the resonance frequency enables changes in power while reducing losses of the switching element. When supplying a relatively small power, changing the driving frequency of the switching element enables power control without needing any de-boosting circuit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, and wherein the control unit is configured to select one of the first control mode and the second control mode based on the temperature detected by the temperature detection unit, the boosting ratio, and the driving frequency.

2. The fixing apparatus according to claim 1, wherein the control unit is configured to maintain the boosting ratio of the boosting circuit at the predetermined boosting ratio in the first control mode, and to maintain the driving frequency of the switching element at the predetermined frequency in the second control mode.

3. The fixing apparatus according to claim 1, wherein the control unit is configured to execute the first control mode at the time of starting an operation of the fixing apparatus.

4. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, and wherein in a state where the first control mode is selected, when the temperature detected by the temperature detection unit is lower than the target temperature, if a value obtained by decreasing a driving frequency that is set when the temperature is detected by the temperature detection unit by a predetermined value is lower than the predetermined frequency, the control unit is configured to switch from the first control mode to the second control mode.

5. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, and wherein in a state where the second control mode is selected, when the temperature detected by the temperature detection unit is higher than the target temperature, if a value obtained by decreasing a boosting ratio that is set when the temperature is detected by the temperature detection unit by a predetermined value is lower than the predetermined boosting ratio, the control unit is configured to switch from the second control mode to the first control mode.

6. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, wherein in a state where the first control mode is selected, when the temperature detected by the temperature detection unit is lower than the target temperature, and the power to be supplied to the induction heating coil is set higher than first predetermined power, the control unit is configured to switch from the first control mode to the second control mode, and wherein the first predetermined power is power smaller than the power supplied to the induction heating coil when the boosting ratio of the boosting circuit is equal to the predetermined boosting ratio and the driving frequency is equal to the predetermined frequency.

7. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, wherein in a state where the second control mode is selected, when the temperature detected by the temperature detection unit is higher than the target temperature, and the power to be supplied to the induction heating coil is set lower than second predetermined power, the control unit is configured to switch from the second control mode to the first control mode, and wherein the second predetermined power is power larger than the power supplied to the induction heating coil when the boosting ratio of the boosting circuit is equal to the predetermined boosting ratio and the driving frequency is equal to the predetermined frequency.

8. A fixing apparatus comprising:

an induction heating coil configured to heat a heat generating member including a conductive heating element;

a boosting circuit configured to boost a DC voltage obtained by rectifying AC power;

a switching element configured to input a DC voltage boosted by the boosting circuit and to supply a high-frequency current to the induction heating coil;

a driving circuit configured to drive the switching element;

a temperature detection unit configured to detect a temperature of the heat generating member; and a control unit configured to control power supplied to the induction heating coil by controlling a boosting ratio of the boosting circuit and a driving frequency of the switching element by the driving circuit so that the temperature detected by the temperature detection unit reaches a target temperature, wherein the control unit is configured to selectively execute a first control mode for controlling the power supplied to the induction heating coil by changing the driving frequency of the switching element within a range of frequencies equal to or higher than a predetermined frequency and a second control mode for controlling the power supplied to the induction heating coil by changing the boosting ratio of the boosting circuit within a range of ratios equal to or higher than a predetermined boosting ratio, and wherein the control unit is configured to increase the power to be supplied to the induction heating coil when the temperature detected by the temperature detection unit is lower than the target temperature, to decrease the power to be supplied to the induction heating coil when the temperature detected by the temperature detection unit is higher than the target temperature, to select the first control mode when the power to be supplied is smaller than the predetermined power, and to select the second control mode when the power to be supplied is larger than the predetermined power.

9. The fixing apparatus according to claim 8, wherein the predetermined power is power supplied to the induction heating coil when the boosting ratio of the boosting circuit is equal to the predetermined boosting ratio and the driving frequency is equal to the predetermined frequency.

10. The fixing apparatus according to claim 8, further comprising a table configured to store data indicating a relationship between the boosting ratio and the driving frequency corresponding to the power to be supplied, wherein in the data of the table, the boosting ratio and the driving frequency are determined according to the first control mode within a range in which the power to be supplied is smaller than the predetermined power, and are determined according to the second control mode within a range in which the power to be supplied is larger than the predetermined power.

11. A fixing apparatus configured to fix an image formed on a sheet, the fixing apparatus comprising:

an inductive heating element;

a driving signal generating unit configured to generate driving signals to be supplied to the inductive heating element;

a temperature detection unit configured to detect a temperature of an object heated by the inductive heating element; and a control unit configured to control a voltage and a frequency of the driving signals in dependence upon the detected temperature so as to tend to maintain the object at a target temperature, the control unit being switchable between a first control mode, in which the voltage of the driving signals is maintained substantially at a predetermined voltage and the frequency of the driving signals is changed, and a second control mode in which the frequency of the driving signals is maintained substantially unchanged and the voltage of the driving signals is changed to a voltage greater than or equal to the predetermined voltage.

12. The fixing apparatus according to claim 11, wherein in the second control mode the driving signal generating unit is operable to generate the driving signals by boosting an input voltage and in the first control mode the driving signal generating unit is operable to generate the driving signals without boosting the input voltage.

13. The fixing apparatus according to claim 11, wherein the driving signal generating unit is configured to form a resonant circuit with the inductive heating element, and in the second control mode the frequency of the driving signals is maintained at or close to a resonant frequency of the resonant circuit.

14. A fixing apparatus configured to fix an image formed on a sheet, the fixing apparatus comprising:

an inductive heating element;

a driving signal generating unit configured to generate driving signals to be supplied to the inductive heating element;

a temperature detection unit configured to detect a temperature of an object heated by the inductive heating element; and a control unit configured to control a voltage and a frequency of the driving signals in dependence upon the detected temperature so as to tend to maintain the object at a target temperature, the control unit being switchable between a first control mode, in which the voltage of the driving signals is maintained substantially unchanged and the frequency of the driving signals is changed to a frequency greater than or equal to a predetermined frequency, and a second control mode in which the frequency of the driving signals is maintained substantially at the predetermined frequency and the voltage of the driving signals is changed.

15. The fixing apparatus according to claim 14, wherein in the second control mode the driving signal generating unit is operable to generate the driving signals by boosting an input voltage and in the first control mode the driving signal generating unit is operable to generate the driving signals without boosting the input voltage.

16. The fixing apparatus according to claim 14, wherein the driving signal generating unit is configured to form a resonant circuit with the inductive heating element, and in the second control mode the frequency of the driving signals is maintained at or close to a resonant frequency of the resonant circuit.

17. A fixing apparatus configured to fix an image formed on a sheet, the fixing apparatus comprising:

an inductive heating element;

a driving signal generating unit configured to generate driving signals to be supplied to the inductive heating element;

a temperature detection unit configured to detect a temperature of an object heated by the inductive heating element; and a control unit configured to control a voltage and a frequency of the driving signals in dependence upon the detected temperature so as to tend to maintain the object at a target temperature, the control unit being switchable between a first control mode, in which the voltage of the driving signals is maintained substantially unchanged and the frequency of the driving signals is changed, and a second control mode in which the frequency of the driving signals is maintained substantially unchanged and the voltage of the driving signals is changed, wherein the control unit is operable to switch from the first control mode to the second control mode when the detected temperature is less than the target temperature and the power supplied is less than a first reference power, and is further operable to switch from the second control mode to the first control mode when the detected temperature is greater than the target temperature and the power supplied is greater than a second reference power greater than the first reference power.

18. The fixing apparatus according to claim 17, wherein the first reference power is less than a power supplied when the driving signals have the predetermined voltage and the predetermined frequency, and the second reference power is greater than the power supplied when the driving signals have the predetermined voltage and the predetermined frequency.

* * * * *